US005505180A

United States Patent [19]

Otterman et al.

[11] Patent Number: 5,505,180

[45] Date of Patent: Apr. 9, 1996

[54] RETURNLESS FUEL DELIVERY MECHANISM WITH ADAPTIVE LEARNING

[75] Inventors: John R. Otterman, Ypsilanti; Michael R. Tinskey, Farmington, both of Mich.

[73] Assignee: Ford Motor Company, Dearborn, Mich.

[21] Appl. No.: 414,162

[22] Filed: Mar. 31, 1995

[51] Int. Cl.[6] ..... F02M 37/04

[52] U.S. Cl. ..... 123/497

[58] Field of Search ..... 123/497

[56] References Cited

U.S. PATENT DOCUMENTS

| | | | |
|---|---|---|---|
| 4,982,331 | 1/1991 | Miyazaki | 123/497 |
| 4,993,391 | 2/1991 | Kuribara et al. | 123/497 |
| 5,092,302 | 3/1992 | Mohan | 123/497 |
| 5,207,199 | 5/1993 | Sekiguchi | 123/357 |
| 5,237,975 | 8/1993 | Betki et al. | 123/497 |
| 5,379,741 | 1/1995 | Matysiewicz et al. | 123/497 |
| 5,444,627 | 8/1995 | Sandborg et al. | 123/357 |

FOREIGN PATENT DOCUMENTS

| | | | |
|---|---|---|---|
| 58-15755 | 1/1983 | Japan | 123/497 |

*Primary Examiner*—Thomas N. Moulis
*Attorney, Agent, or Firm*—Kimberly Scott; Roger L. May

[57] ABSTRACT

An adapting mechanism for controlling the speed of a variable speed fuel pump in a returnless fuel delivery system includes a demand sensor, feedforward fuel pump values, adaptive adjustments corresponding to the feedforward values, a pump controller which controls the speed of the fuel pump, a timer, a steady demand indicator, a flow error accumulator, and an adjustor. The system chooses a feedforward value which corresponds to the engine's fuel demand and combines it with the corresponding adaptive adjustment to drive the fuel pump. The system monitors the average flow error over a time interval throughout which the fuel demand is substantially steady and modifies the adaptive adjustments to reduce any error offsets beyond a predetermined acceptable level.

10 Claims, 6 Drawing Sheets

RETURNLESS FUEL DELIVERY MECHANISM WITH ADAPTIVE LEARNING

FIELD OF THE INVENTION

The present invention relates to a mechanism for determining the precise quantity of fuel required by an internal combustion engine and delivering that quantity from the fuel tank, and more particularly, to adapting the fuel delivery system operating characteristics to detect and reflect changes in the engine and fuel system over time.

BACKGROUND OF THE INVENTION

A conventional fuel delivery system for an internal combustion engine typically includes a fuel pump which runs at a constant speed and supplies a constant quantity of fuel to the engine. Since the engine's fuel requirements vary widely with operating and environmental conditions, much of the fuel supplied is not actually needed by the engine and must accordingly be returned to the fuel tank. This returned fuel is generally at a higher temperature and pressure than the fuel in the tank. Returning it to the tank can generate fuel vapors, which must be processed to eliminate environmental concerns.

Returnless fuel systems have been developed to address these concerns. These systems generally determine how much fuel the engine requires at each particular point in time and supply only this required amount of fuel to the engine, eliminating the need to return fuel. A number of engine signals, such as manifold pressure, fuel temperature, and other operating characteristics may be monitored to help determine the required quantity. This requirement is then translated into a fuel pump control signal to control the quantity of fuel pumped to the engine over a specific time period. Such systems often use equations or maintain tables of values which translate the engine signals into actual fuel pump drive data. For example, U.S. Pat. Nos. 5,237,975 and 5,379,741 disclose systems which use lookup tables to translate engine signals into a pump duty cycle.

Feedback is provided in a returnless fuel system to help adjust the fuel supply to meet the fuel demands of the engine. Over time, vehicle wear may change the engine's fuel demand characteristics. Under a given set of operating conditions, a greater or lesser quantity of fuel may thus be required than what was once required under identical conditions when the vehicle was new. Also, fuel system wear and conditions such as a clogged fuel filter, for example, may change the quantity of fuel supplied for a specific pump setting. While feedback eventually accommodates these changes during real time operation, it would be desirable to have an improved system which learns of the changes, incorporates the changes into the base determination of demand, and adapts the underlying tables or equations accordingly. The present invention is directed at making this adaptation.

SUMMARY OF THE INVENTION

An adapting mechanism for controlling the speed of a variable speed fuel pump in a returnless fuel delivery system includes a demand sensor, feedforward fuel pump values, adaptive adjustments corresponding to the feedforward values, a pump controller which controls the speed of the fuel pump, a timer, a steady demand indicator, a flow error accumulator, and an adjustor. The system looks at the engine's fuel demand and chooses a corresponding feedforward value. It combines this feedforward value with a corresponding adaptive adjustment and uses the combination to drive the fuel pump. The system also monitors the average flow error over a time interval. If the fuel demand has been substantially steady throughout the time interval and the average flow error has exceeded a predetermined acceptable level, then the system modifies the adaptive adjustment which corresponds to the present level of demand to reduce the error offset. The system saves the modified adaptive adjustment for future use and further refinement as fuel demand conditions warrant.

A primary object of the present invention is to provide an improved returnless fuel system which tracks fundamental changes in pump operation voltage relative to pump output and removes systematic error.

A primary advantage of the present invention is that it quickly learns of changes to the system demand characteristics and quickly adapts the pump voltage of the returnless fuel system as necessary to reflect these changes. An additional advantage is that the adaptations determined by prior system operation are retained for future use and refinement as necessary.

Other objects, features, and advantages will be apparent from a study of the following written description and drawings.

DETAILED DESCRIPTION OF THE PREFERRED EMBODIMENTS

Figure 1:
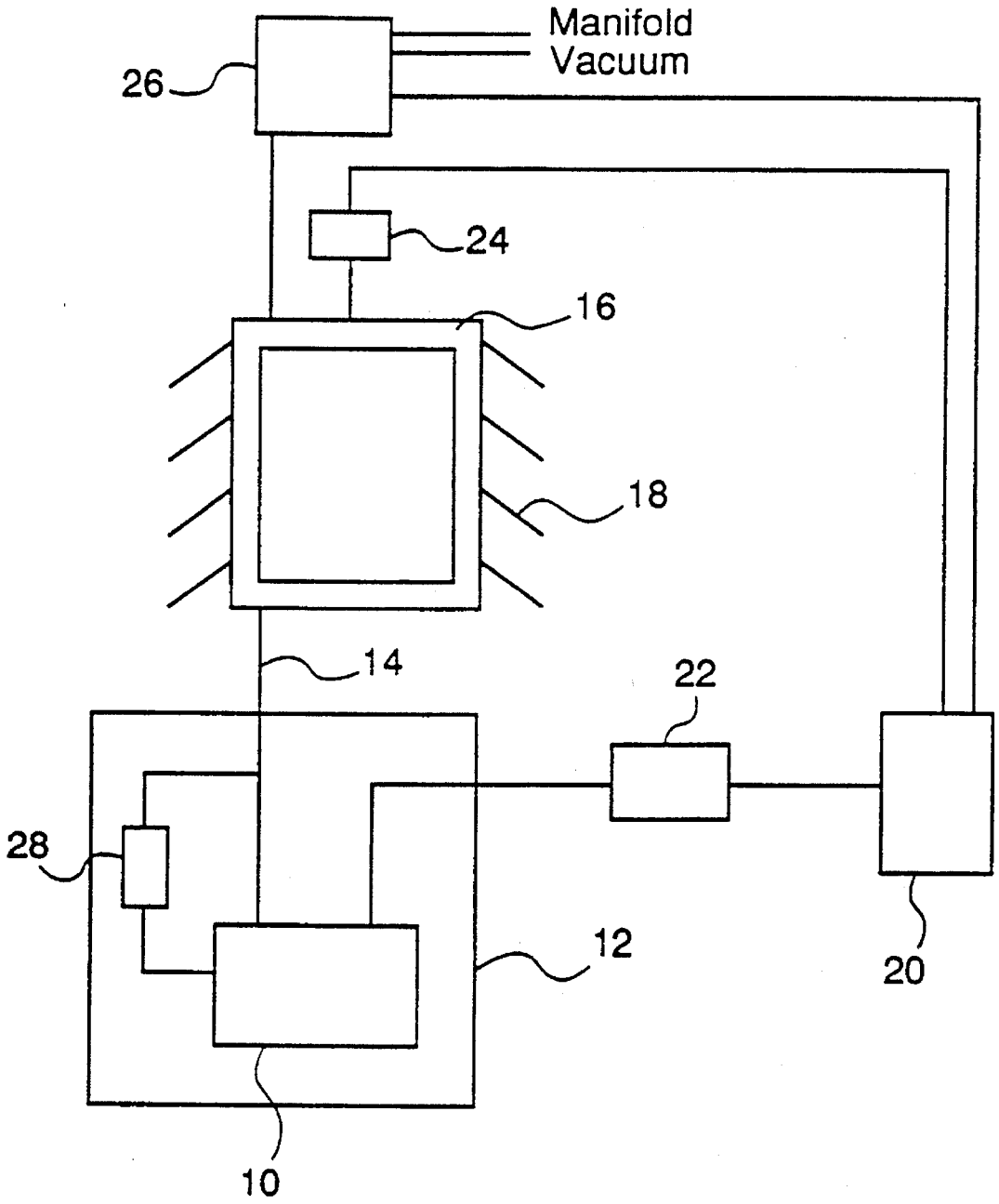
FIG. 1 is a block diagram of a returnless fuel system according to the prior art.

According to FIG. 1, a returnless fuel delivery system includes a fuel pump 10 located within a fuel tank 12 of a vehicle. Pump 10 supplies fuel through a supply line 14 to a fuel rail 16 for distribution to a plurality of injectors 18. The speed of fuel pump 10 is controlled by an engine control module 20. Module 20 acts as a system controller for the returnless fuel delivery system, supplying control signals which are amplified and frequency multiplied by a power driver 22 and supplied to pump 10. Module 20 receives a fuel temperature input from a fuel temperature sensor 24 as well as input from a differential pressure sensor 26. Sensor 26 responds to intake manifold vacuum and to the pressure in fuel rail 16 to provide a differential pressure signal to module 20. Module 20 uses this information to determine the fuel pump voltage needed to provide the engine with optimum fuel pressure and fuel flow rate. Note that while a preferred embodiment utilizes differential pressure, other methods can be used to make this determination.

Continuing with FIG. 1, a pressure relief valve 28 positioned in parallel with a check valve in fuel supply line 14 prevents excessive pressure in fuel rail 16 during engine-off hot soaks. Also, relief valve 28 assists in smoothing engine-running transient pressure fluctuations. Those skilled in the art will appreciate that module 20 also controls the pulse width of a fuel injector signal applied to injectors 18 in order to control the amount of fuel injected into the engine cylinders in accordance with a control algorithm. This signal is a variable frequency, variable pulse width signal that controls injector valve open time.

Figure 2:
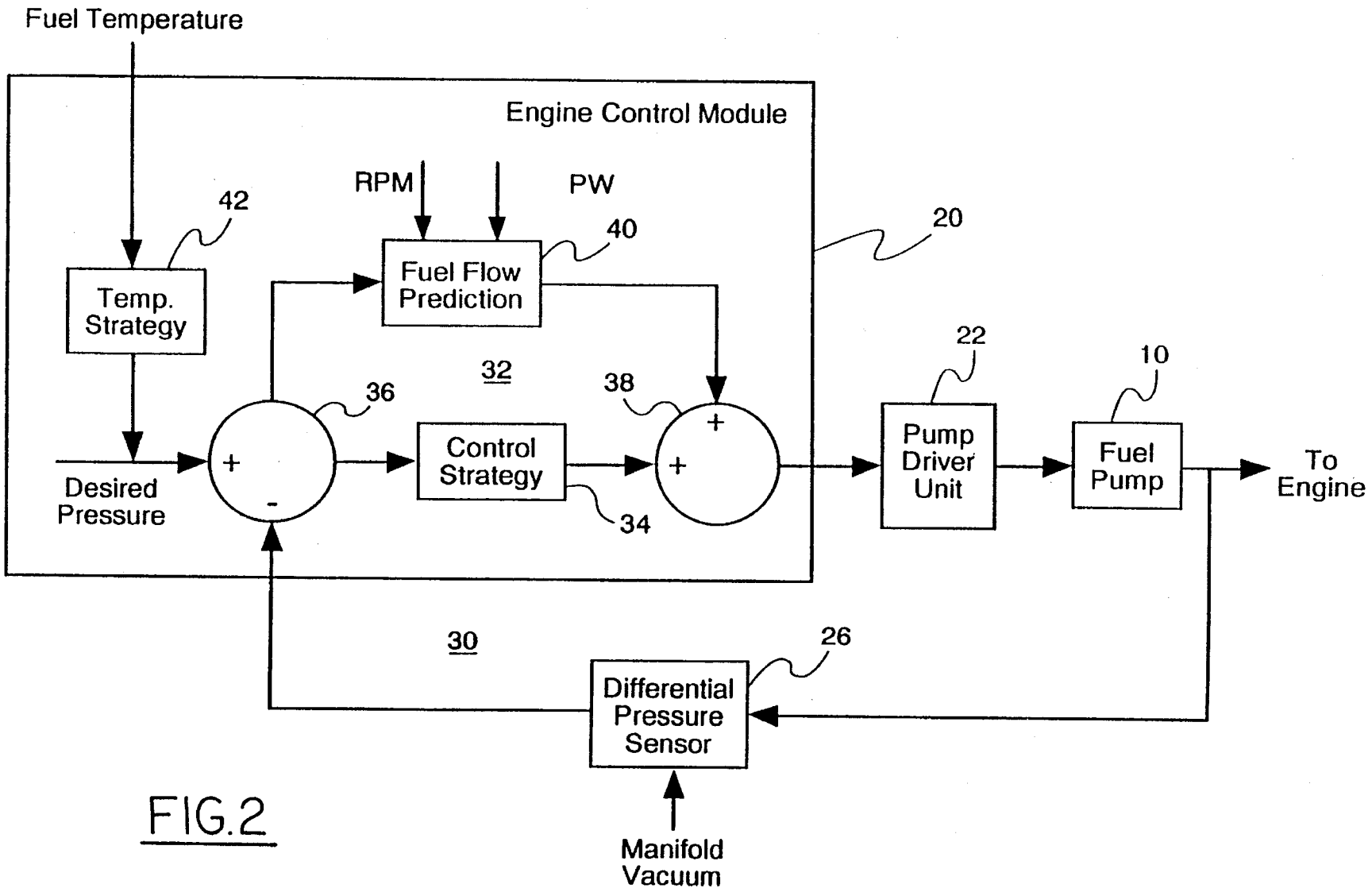
FIG. 2 is a control diagram showing a control strategy of a returnless fuel system according to the prior art.

Referring now to FIG. 2, module 20 generates a constant frequency pulse width modulated (PWM) fuel pump control signal in accordance with an overall control strategy which includes a Proportional-Integral-Derivative (PID) feedback loop generally designated 30 which monitors flow error, and a feedforward loop generally designated 32 for determining the fuel pump speed. Loop 30 includes a control strategy block 34 which responds to the error output of a comparator 36 which represents the difference between a desired differential pressure input and the actual differential pressure as input from a differential pressure sensor 26. The output of control strategy block 34 represents the time history of the error input and is combined in a summer 38 with the output of a fuel flow prediction block 40 to vary the duty cycle of the PWM signal to the fuel pump 10, in a sense to reduce the error input to block 34 toward zero and maintain a substantially constant differential pressure.

In a preferred embodiment, loop 30 includes a PID device for measuring the flow error of the returnless fuel system. The PID device contains an integral function whose output represents the average error over time between the desired fuel flow and the system's actual fuel flow. The error may be positive, negative, or zero, depending on which of the two flows is the greater over the time period. Note that while a preferred embodiment utilizes a PID, other means of determining the flow error could also be used.

Since loop 30 responds to differential pressure, a sudden change in manifold vacuum can produce transient instability. Such a change might occur, for example, where a driver suddenly requests full throttle. Fuel flow prediction block 40 compensates for this instability by utilizing engine RPM and injector pulse width (PW) to predict mass fuel flow demanded. The variables are obtained by monitoring one of the fuel injector control lines. These inputs define a particular operating point which is pinpointed in a table to provide a corresponding optimum duty cycle for the PWM signal to pump 10. Fuel flow prediction 40 provides a relatively quick response to engine operating conditions which cannot be controlled by PID loop 30. PID loop 30 provides a fine tuning of the overall control strategy and compensates for pump and engine variability.

While it is desirable to eliminate the return line to the fuel tank, doing so prevents fuel from being used as a coolant. At idle, where fuel flow to the engine is low, the fuel in the fuel rail is heated by convection from the engine. If the target fuel reaches its vapor point on the distillation curve, it could vaporize, causing less fuel to be delivered through the injectors for a given pulse width injector control signal. A temperature strategy block 42 is employed to compensate for this potential mass flow reduction. Block 42 responds to the output of fuel temperature sensor 24 and modifies the desired pressure input to comparator 36 as a function of the temperature of the fuel in the rail. Thus, as the fuel temperature increases, the error signal to control strategy block 34 increases, resulting in an increase in the duty cycle of the control signal to pump 10 which raises the pressure in fuel rail 16, thus maintaining the mass flow through injectors 18. The same amount of fuel is thus delivered to cylinders regardless of temperature change and without having to alter the pulse width of the fuel injector control signal. Loop 30 is primarily responsible for increasing fuel pressure in response to fuel temperature increases. Under low temperature conditions the speed of pump 10 is primarily determined by fuel flow prediction block 40.

Figure 3:
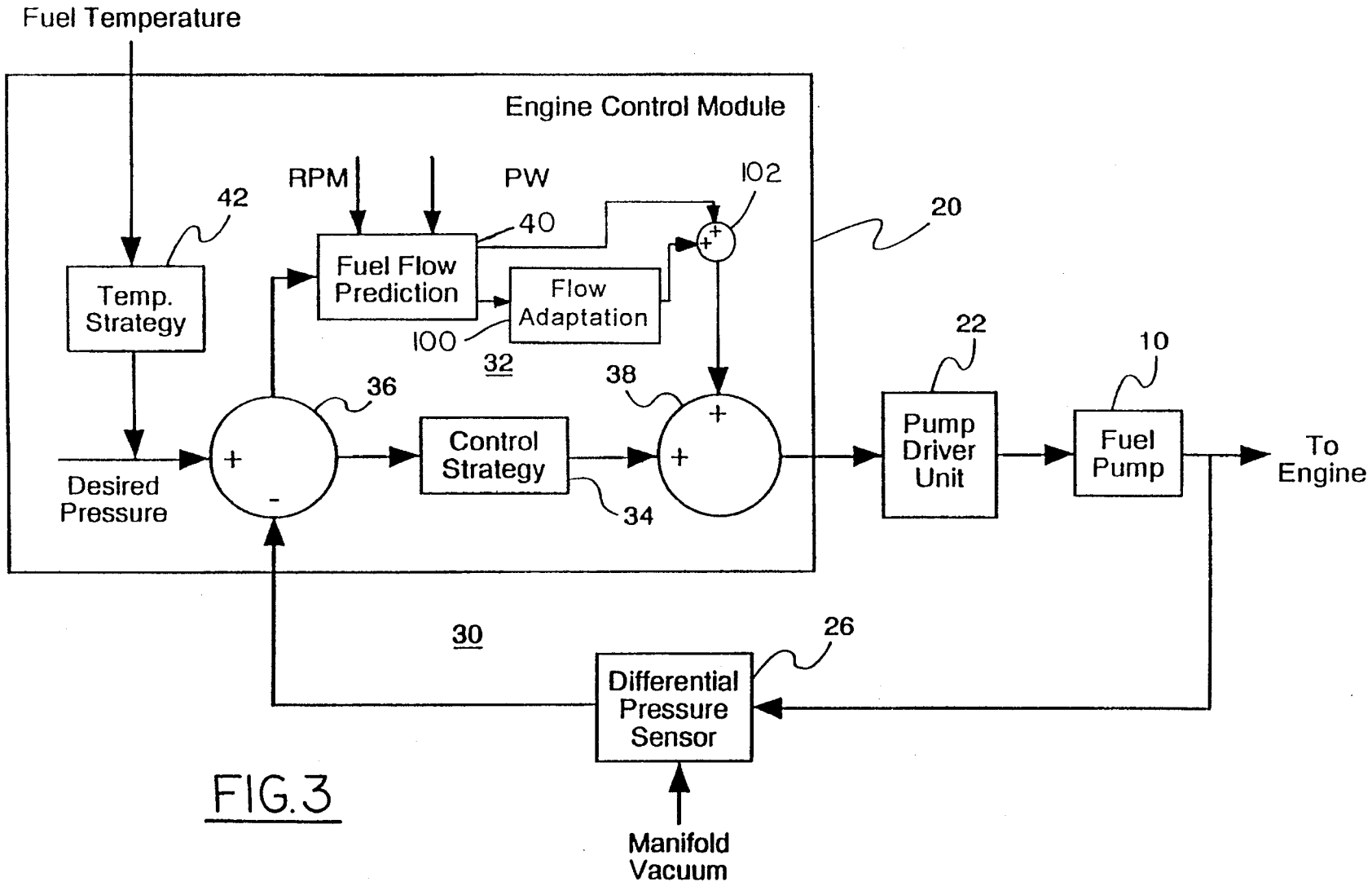
FIG. 3 is a control diagram showing the improvement of the present invention in relation to the underlying control strategy of a returnless fuel system.

Referring now to FIG. 3, an improvement according to the present invention is shown by a flow adaptation block 100 and a summer 102. Flow adaptation block 100 includes an adjusting mechanism which adapts the output of fuel flow prediction block 40 for changes in the fuel system over time which manifest themselves as constant systematic or offset error. For example, after five years a particular fuel pump operating in a vehicle might provide less fuel for a given fuel pump duty cycle than it did for that duty cycle when it was new. Flow adaptation block 100 adapts the system to these changes by monitoring the average flow error supplied by control strategy block 34 over a time interval and generating cumulative adaptive adjustments to the duty cycle which was computed by fuel flow prediction block 40. This is important because adjustments should not be based on errors resulting from transient conditions due to significant fluctuations in demand. In a preferred embodiment, these adaptive adjustments are kept in a table whose entries correspond to the feedforward fuel pump duty cycle table. Before altering a particular adaptive adjustment, flow adaptation block 100 verifies that the system is operating under steady fuel flow demand throughout this interval based on information from fuel flow prediction block 40. Block 40 also supplies information to indicate which of the adaptive adjustment values should be modified.

As part of the improved system's regular operation, summer 102 adds the adaptive adjustment to the base feedforward fuel pump duty cycle selected by feedforward loop 32. The adjusted feedforward value then continues into summer 38 and is treated as discussed previously in FIG. 2.

Continuing with FIG. 3, computing and incorporating adaptive adjustments to the feedforward fuel pump duty cycles provide a more rapid response to system changes than can be accommodated by PID feedback loop 30. Additionally, these adjustments can be stored for future use. In a preferred embodiment, flow adaptation block 100 utilizes EEPROM (not shown) for storing the adjustments, which are kept in a table that corresponds to the table of feedforward fuel pump duty cycles. EEPROM permits the adjustments to be retained while the system is without power so that they may be used during subsequent operation. It also permits the adjustments to be modified as additional system changes warrant. Note that while a preferred embodiment utilizes pump duty cycle, other representations of pump voltage or current could also be used. The term feedforward fuel pump value is used to encompass these various representations.

Figure 4:
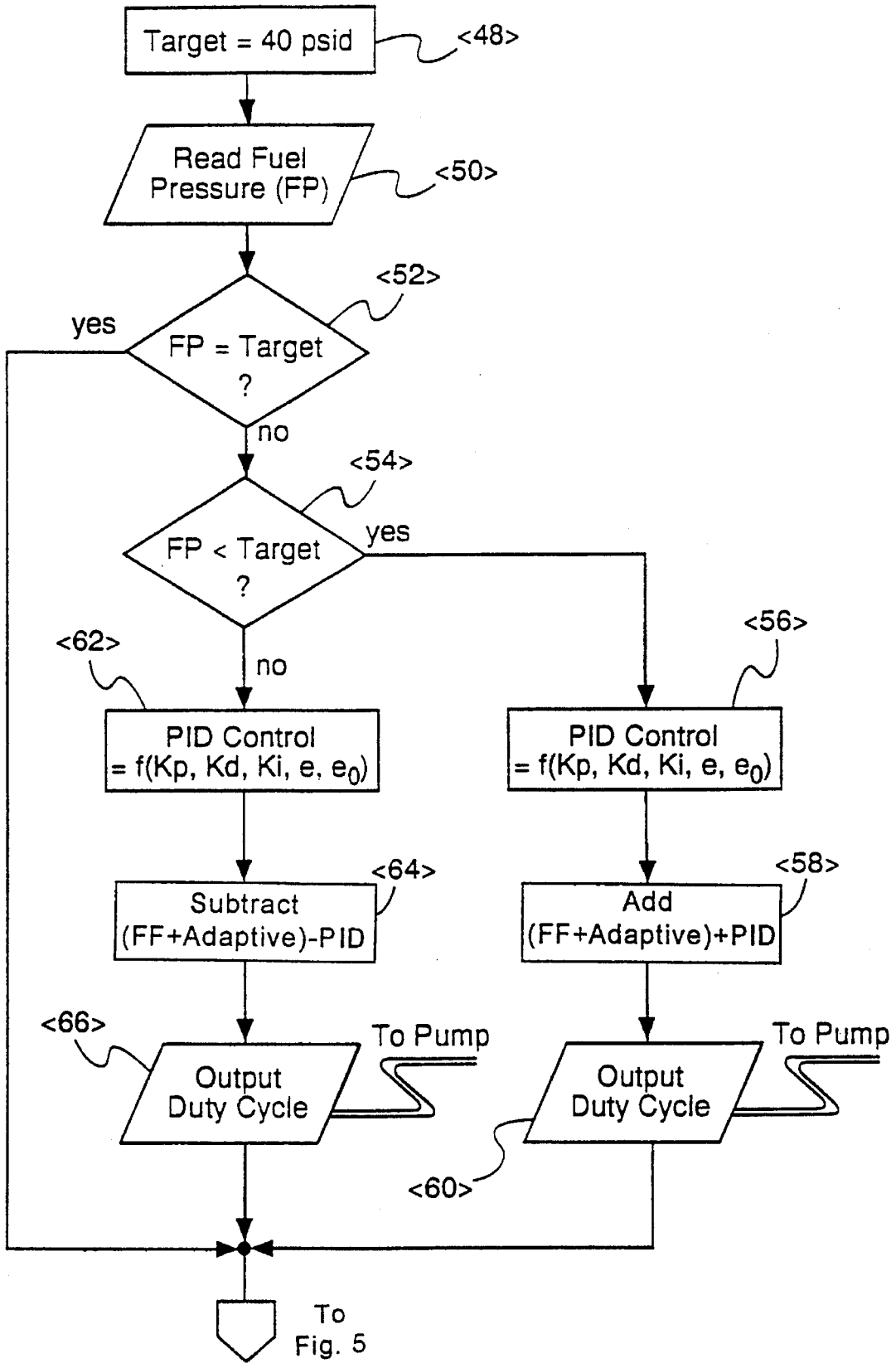
FIG. 4 is a flow chart showing how the improvement of the present invention fits into a fuel control method for a returnless fuel system.

Turning now to FIG. 4, a flow chart of a fuel pump control program for a returnless fuel system, such as module 20 might follow, sets <48> a target differential fuel pressure of, for example, 40 psid. Module 20 then monitors <50> the differential fuel pressure measured by sensor 26, comparing these two to see whether they are equal <52>. If differential pressure matches target pressure, then no adjustment need be made.

If differential pressure is less than <54> target pressure, then the PID control strategy output <56> is added to the sum of the feedforward fuel pump duty cycle and adaptive adjustment terms <58>. This increases the duty cycle of the fuel pump PWM signal, increasing the pressure in the fuel rail when it is output <60> to the fuel pump.

If differential pressure is greater than <54> target pressure, then the PID control strategy output <62> is subtracted from the sum of the feedforward fuel pump duty cycle and adaptive adjustment terms <64>. This decreases the duty cycle of the fuel pump PWM signal, decreasing the pressure in the fuel rail when it is output <66> to the fuel pump.

Figure 5:
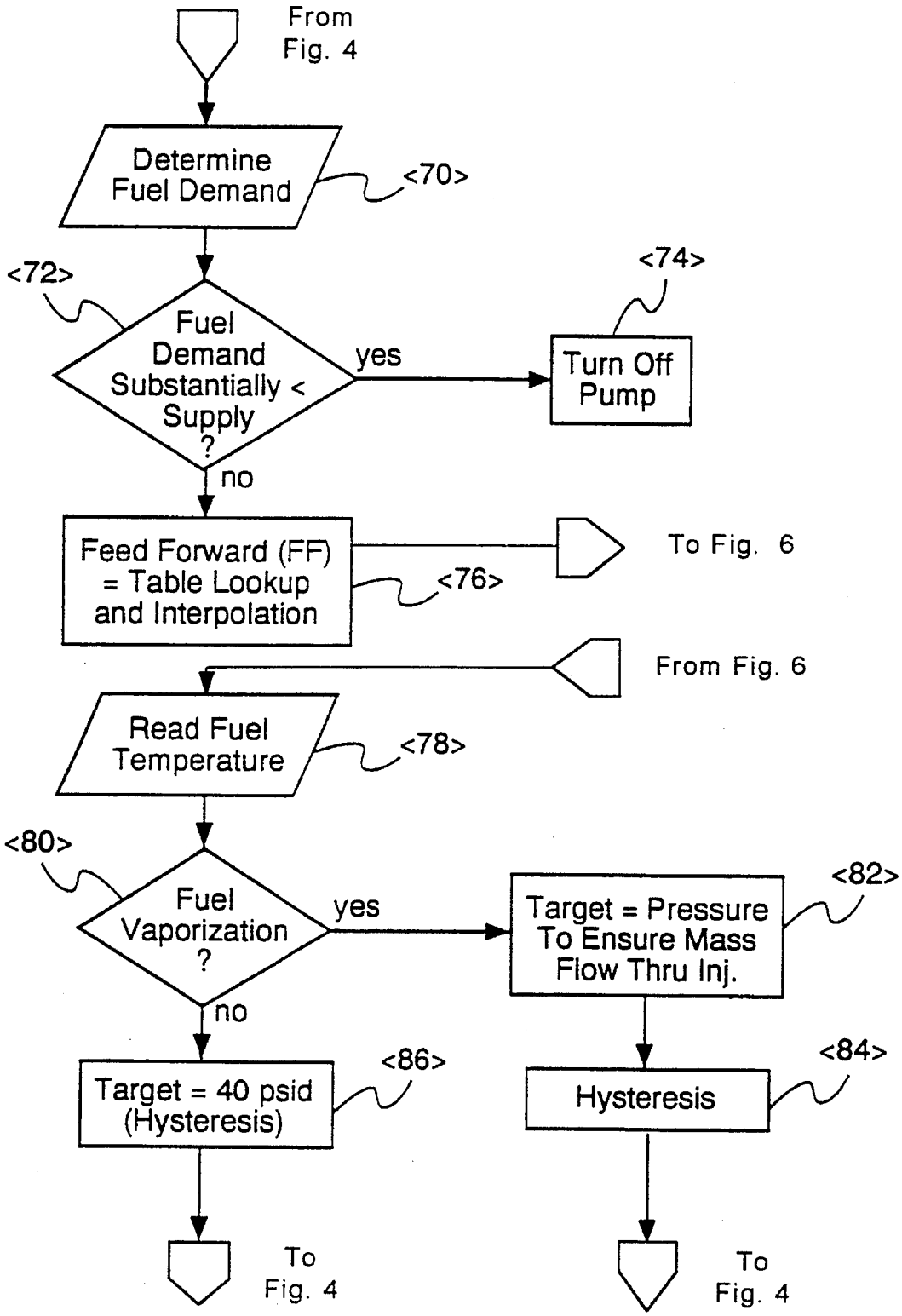
FIG. 5 is a flow chart showing when the improvement of the present invention is computed relative to a fuel demand prediction routine and temperature strategy for a returnless fuel system.

FIG. 5 shows the computation of the feedforward fuel pump duty cycle whose result is used in blocks <58> and <64> of FIG. 4. First, fuel demand is determined <70> by monitoring one of the fuel injector control signals to obtain the signal's period and pulse width. If demand is substantially less than supply <72>, then the fuel pump is turned off hydraulically <74> such that little or no fuel flows to the engine. If demand is not substantially less than supply, then engine RPM is obtained from the period or duration of the fuel injector control signal, and it is used, along with the pulse width, to determine <76> a feedforward fuel pump duty cycle for driving the pump. Note that while a preferred embodiment utilizes RPM and injector pulse width, other means of determining fuel demand, and hence fuel to be supplied, could also be used. Furthermore, while a preferred embodiment of the present invention utilizes tables of feedforward fuel pump duty cycles and interpolates between the points, functional equations or other computational methods could also be utilized if desirable. The feedforward fuel pump duty cycle of <76> does not reflect the contributions of the adaptive adjustment, which in a preferred embodiment is computed separately as shown in FIG. 6 and incorporated as shown in FIG. 4.

Continuing with FIG. 5, the next section shows the temperature strategy routine which is used to compute the target differential pressure shown in FIG. 4 at block <48>. Note that while the routine is shown here, it could alternatively be computed as part of <48> or at other opportunities as desired. The routine begins by reading the fuel rail temperature <78> and checking to see whether it exceeds a predetermined level above which vaporization occurs <80>. If not, then the usual target differential pressure of, for example, 40 psid is utilized <86>.

If the fuel rail temperature exceeds the predetermined level for vaporization, then the target differential pressure is increased <82> to a value that will cause the PID loop to increase the fuel pump duty cycle. This ensures the desired mass fuel flow through the injectors. Hysteresis <84>, <86> in the switching mechanism assures that the temperature/pressure relationship uses different trigger points when the temperature is increasing over normal than when it is decreasing back towards normal. This prevents chattering when the temperature is close to the trigger level and keeps the system from being fooled by the cooling effects of other engine phenomena, such as wide open throttle.

Figure 6:
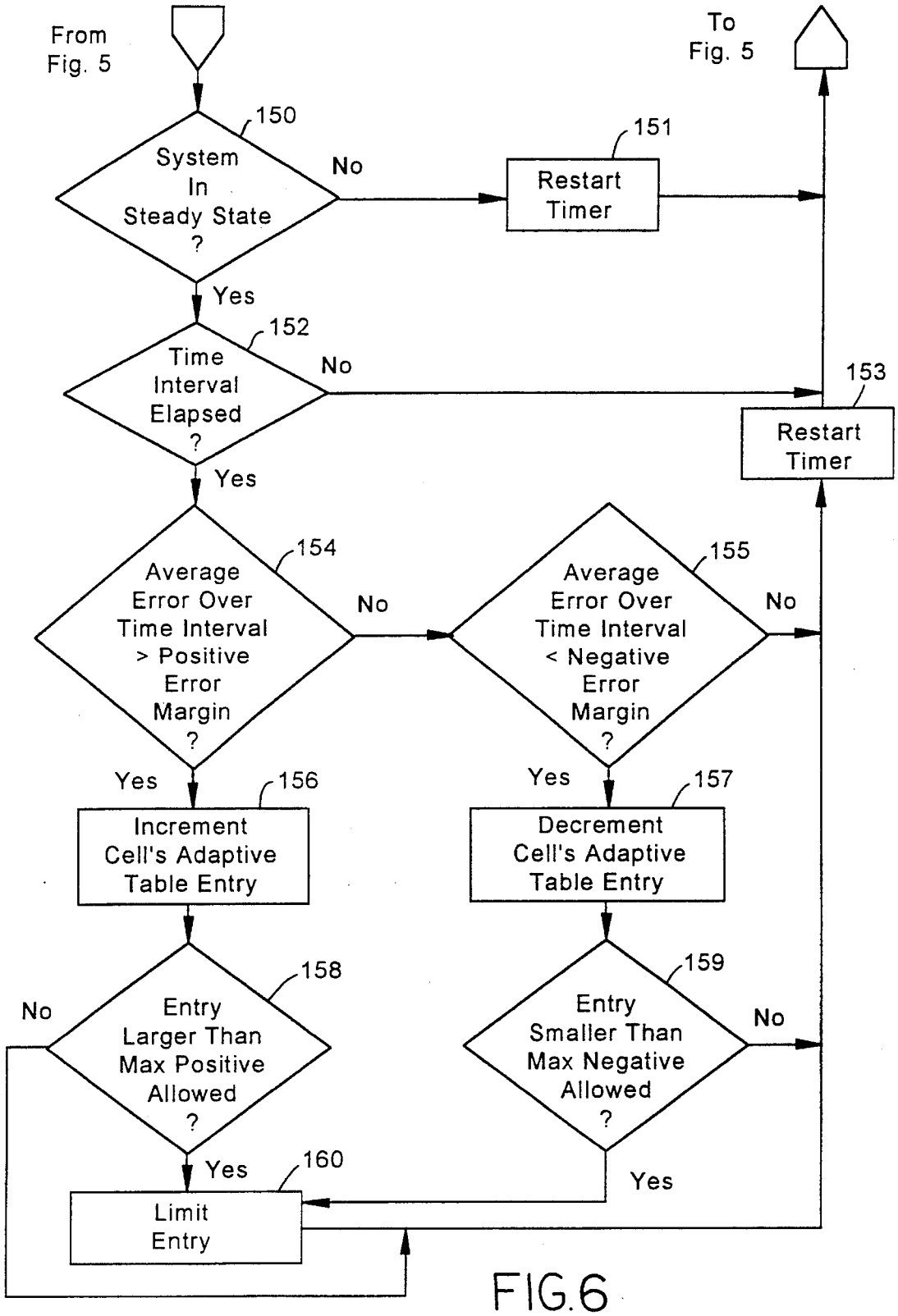
FIG. 6 is a flow chart showing a fuel control adaptation method of a preferred embodiment of the present invention.

Turning now to FIG. 6, a fuel adaptation method according to a preferred embodiment of the present invention details the adaptive learning improvement. In general, the improvement includes computing an adaptive adjustment to be added to or subtracted from the traditional feedforward fuel pump duty cycle output. The first criteria is to check <150> whether the returnless fuel delivery system has been operating under steady fuel flow demand from the engine throughout the time interval over which an adjustment is to be computed. This is done to ensure that fluctuations between fuel supply and demand caused by dynamic changes in fuel demand do not get misinterpreted as systematic errors. In a preferred embodiment, this can be determined by checking to see whether different areas of the feedforward table have been used during the interval.

If the system has not been operating under steady fuel flow demand, then the interval timer is restarred <151> and the system makes no further adjustments. If the system has operated under steady fuel flow demand, then the system checks <152> to see whether the time interval has elapsed. If the time interval has not elapsed, the system makes no further adjustments.

If the time interval has elapsed, then the system looks at the average flow error experienced throughout the time interval, which in a preferred embodiment is reflected by the integral term of the PID. Since the integral increases positively or negatively with constant error and moves towards zero as the error changes sign, the integral term thus represents the average system error over the time interval, with the sign indicating whether this error is negative or positive. In a preferred embodiment, the general criteria for making adaptive adjustments is to make them when (PID Integral>Positive Error Limit) or when (PID Integral<Negative Error Limit), with the positive and negative error limits defining a predetermined range of expected error.

Note that while a preferred embodiment utilizes differential pressure as reflected by the PID integral to determine flow error, other methods could be used, such as monitoring the fuel stream. What is required is to measure the flow actually supplied by the returnless fuel system against the flow demanded from the returnless fuel system, which is reflected by the feedforward and adaptive terms, and compare the average difference over the time interval against some level of acceptable fluctuation.

Continuing with FIG. 6, if the average error over the time interval exceeds the positive error limit then it is attributed to systematic error, and an adjustment must be made to increase the size of the adaptive adjustment which corresponds to the feedforward fuel pump duty cycle currently being utilized <156>.

If the average error over the time interval does not exceed the predetermined positive error margin, then no positive adjustment is required but a negative adjustment may be necessary. A negative adjustment is required when the average error over the time interval is smaller than the negative error threshold, indicating that the fuel pump voltage should be decreased. The system checks <155> for this situation and if it exists, then the size of the adaptive adjustment which corresponds to the feedforward fuel pump duty cycle presently being utilized is decreased <157>.

Note that while a preferred embodiment uses single-step adjustments, the size of the adjustment could vary as system demands warrant. Also, while a preferred embodiment utilizes separate positive and negative error thresholds, these two thresholds could be combined into one error assessment by using, for example, an absolute value comparison. Having separate thresholds permits greater flexibility in establishing a range of acceptable error.

For positive adjustments, the system next checks <158> to see whether the adaptive cell is beyond the maximum positive adjustment allowable. If it is, the system will limit it to a preestablished maximum positive adjustment <160>. Similarly for negative adjustments, the system checks <159> to see whether the adaptive cell is beyond the maximum negative adjustment allowed. If so, the system limits the adjustment <160> to a maximum negative entry. For example, if the maximum positive adjustment is 10 units, any adaptive entry greater than 10, such as 11, will be limited to 10. If the maximum negative adjustment is −10, then any adaptive entry beyond −10, such as −11, will be limited to −10. This permits the system to be flexible but also enables it to bring significant operational characteristics to the operator's attention, if desired. Finally, the window timer is restarred <153>, and the system continues executing according to FIG. 5.

While the fuel adaptation method shown in FIG. 6 is performed as a subset of the steps of FIG. 5, it could be performed at another opportunity if desired by utilizing, for example, an interval timer interrupt routine. Note that while a preferred embodiment incorporates the resulting adaptive value in the duty cycle calculation shown in FIG. 4 at blocks <64> and <58>, it could alternatively be incorporated elsewhere as desired.

From the foregoing description, one of ordinary skill in the art can easily ascertain the essential characteristics of this invention and, without departing from the spirit and scope of the claims, can make various changes and modifications to the invention to adapt it to various usages and conditions.

We claim:

1. An adaptive mechanism for controlling the speed of a variable speed fuel pump to control the flow of fuel from a returnless fuel delivery system to an engine, comprising:

demand sensing means for sensing a flow of fuel demanded from the returnless fuel delivery system by the engine;

first storage means, coupled to and for selecting responsive to said demand sensing means, for storing a plurality of primary signals representative of feedforward fuel pump values used for controlling the speed of the fuel pump;

second storage means, coupled to and for selecting responsive to said demand sensing means, for storing a plurality of secondary signals representative of adaptive adjustments to said primary signals, wherein said secondary signals correspond to each of said primary signals;

pump control means, coupled to said first storage means, said second storage means, and the fuel pump, for controlling the speed of the fuel pump by combining one of said primary signals with one of said secondary signals according to said demand sensing means for driving the fuel pump;

a timer for defining a predetermined time interval;

state determining means, coupled to said timer and said demand sensing means, for generating a steady demand signal representative of said flow of fuel demanded fluctuating only within a predetermined margin throughout said time interval;

error means, coupled to said timer, for measuring an average fuel pump flow error signal representative of the difference between said flow of fuel demanded and a flow of fuel supplied by the returnless fuel system to the engine over said time interval; and adjusting means, coupled to said second storage means, said error means, and said state determining means, for adjusting said secondary signals, but only when receiving said steady demand signal, according to said average fuel pump flow error signal, in order to minimize said average fuel pump flow error signal associated with said flow of fuel demanded when operating under said steady demand signal.

2. A mechanism according to claim 1 further comprising third storage means, coupled to said adjusting means, for storing a plurality of limits defining a range of values for said plurality of secondary signals, and wherein said adjusting means limits said secondary signals to said range of values.

3. A mechanism according to claim 1 wherein said plurality of primary signals are representative of fuel pump duty cycles.

4. A mechanism according to claim 1 wherein said plurality of primary signals are representative of fuel pump voltages.

5. A mechanism according to claim 1 wherein said plurality of primary signals are representative of fuel pump currents.

6. A mechanism according to claim 1 wherein said error means further comprises a proportional-integral-derivative device for generating said average fuel pump error signal.

7. A returnless fuel delivery system for supplying fuel to a fuel rail of an engine, comprising:

a variable speed fuel pump for pumping fuel to the fuel rail;

a temperature sensor for monitoring the temperature of the fuel in the fuel rail;

a differential pressure sensor for sensing the difference in pressure between an intake manifold of the engine and the fuel in the fuel rail; and system control means, coupled to said temperature sensor, said differential pressure sensor, and the fuel pump, for controlling the speed of the fuel pump, said system control means further comprising a timer for defining a predetermined time interval, speed varying means for varying the speed of the variable speed fuel pump to maintain a substantially constant target differential pressure as measured by said differential pressure sensor, temperature compensating means for modifying the substantially constant target differential pressure as a function of temperature reported by said temperature sensor, demand determining means for determining a flow of fuel demanded from the returnless fuel delivery system by the engine, first storage means for storing plurality of primary signals representative of feedforward fuel pump values, one of said primary signals being selected by said demand sensing means for controlling the speed of the fuel pump, second storage means for storing a plurality of secondary signals representative of adaptive adjustments to said primary signals, said secondary signals corresponding to each of said primary signals and selected by said demand sensing means, state determining means for generating a steady demand signal representative of said flow of fuel demanded fluctuating only within a predetermined margin throughout said time interval, error means for measuring an average fuel pump flow error signal representative of the difference between said flow of fuel demanded and a flow of fuel supplied by the returnless fuel system to the engine over said time interval, and adjusting means for adjusting said secondary signals according to said average fuel pump flow error signal, but only when receiving said steady demand signal, wherein said system control means controls the speed of the fuel pump by combining one of said primary signals with one of said secondary signals according to said demand sensing means for driving the fuel pump.

8. A system according to claim 7 wherein said system control means further comprises third storage means, coupled to said adjusting means, for storing a plurality of limits defining a range of values for said plurality of secondary signals and wherein said adjusting means limits said secondary signals to said range of values.

9. In a self-adapting returnless fuel delivery system including a plurality of adaptive adjustments to predetermined feedforward fuel pump values, a method of adapting the system while it is operating comprising the steps of:

initiating a time interval throughout which to monitor the fuel delivery system;

accumulating an average fuel pump flow error, representative of the difference between a flow of fuel demanded and a flow of fuel supplied, throughout said time interval;

verifying that the returnless fuel delivery system has been operating under a steady fuel flow demand state, as represented by said flow of fuel demanded fluctuating only within a predetermined margin throughout said time interval;

detecting when said time interval has ended;

comparing said average fuel pump flow error to a predetermined fuel pump flow error margin;

determining which of the plurality of adaptive adjustments is to be adjusted, based on said flow of fuel demanded;

adjusting the adaptive adjustment, determined in said determining step, but only if the error margin was exceeded in said comparing step; and storing the adaptive adjustment, adjusted in said adjusting step, for future use and further refinement.

10. The method of claim 9 further comprising the step of limiting the adaptive adjustment, adjusted in said adjusting step, to an allowable adjustment range before executing said storing step.

* * * * *